US008621907B2

(12) United States Patent
Liu

(10) Patent No.: US 8,621,907 B2
(45) Date of Patent: Jan. 7, 2014

(54) METHOD FOR MAKING METALLIC CASING

(71) Applicant: Zhi-Da Liu, Shenzhen (CN)

(72) Inventor: Zhi-Da Liu, Shenzhen (CN)

(73) Assignees: Hong Fu Jin Precision Industry (ShenZhen) Co., Ltd., Shenzhen (CN); Hong Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/628,205

(22) Filed: Sep. 27, 2012

(65) Prior Publication Data

US 2013/0019727 A1 Jan. 24, 2013

Related U.S. Application Data

(62) Division of application No. 11/944,464, filed on Nov. 23, 2007, now Pat. No. 8,297,100.

(30) Foreign Application Priority Data

Mar. 28, 2007 (CN) ..... 2007 1 0200340

(51) Int. Cl.
*B21D 28/00* (2006.01)

(52) U.S. Cl.
USPC ..... 72/338; 72/464; 72/470

(58) Field of Classification Search
USPC ..... 72/332–338, 347, 348, 470; 83/620–622; 29/33.52, 34 R
See application file for complete search history.

(56) References Cited

U.S. PATENT DOCUMENTS 1,279,751 A * 9/1918 O'Toole ..... 72/464
2007/0236870 A1 * 10/2007 Hachino et al. ..... 29/592.1

* cited by examiner

*Primary Examiner* — Teresa M Ekiert
(74) *Attorney, Agent, or Firm* — Altis Law Group, Inc.

(57) ABSTRACT

A method for making a metallic casing includes providing an apparatus comprising a first mold and a second mold, placing a preform into a rectangular depression of first mold, moving the first mold to the second mold so that each sharp edge is substantially coplanar with a corresponding cutting edge, moving the first mold to the second mold so that the cutting edges are beyond the corresponding sharp edges of the first mold to complete a partial cut procedure, and moving the first mold to the second mold so that the secondary-cutting edge moves beyond the corresponding sharp edge and completely cuts the excess off the side wall.

8 Claims, 9 Drawing Sheets

METHOD FOR MAKING METALLIC CASING

CROSS-REFERENCE TO RELATED APPLICATION

The present application is a divisional application of U.S. patent application Ser. No. 11/944,464, filed on Nov. 23, 2007.

BACKGROUND OF THE INVENTION

1. Field of the Invention

The present disclosure relates to a method and an apparatus for making a metallic casing, particularly, for making a metallic casing used in portable electronic devices.

2. Discussion of the Related Art

Metallic casings are considered attractive candidates for use in various portable electronic devices such as an MP3 player, personal digital assistance (PDA), and mobile phone because of their sturdiness and appealing appearance.

Referring to FIG. 6, a typical metallic casing 10*a* includes an approximately rectangular base 11*a*, a first sidewall 12*a*, a second sidewall 13*a*, a third sidewall 14*a*, and a fourth sidewall 15*a*. The first sidewall 12*a*, the second sidewall 13*a*, the third sidewall 14*a*, and the fourth sidewall 15*a* all extend around a periphery of the base 11*a*. The first sidewall 12*a*, the second sidewall 13*a*, the third sidewall 14*a*, and the fourth sidewall 15*a* respectively connect to each other. The first sidewall 12*a*, the second sidewall 13*a*, the third sidewall 14*a*, the fourth sidewall 15*a*, and the base 11*a* cooperatively define a cavity (not labeled) with an opening. The cavity is configured for receiving electronic components.

The metallic casing 10*a* is made from a preform 10*b* (shown in FIG. 7). The preform 10*b* is made from a metal plate by a drawing process. The preform 10*b* includes an approximately rectangular base 11*b*, a first sidewall 12*b*, a second sidewall 13*b*, a third sidewall 14*b*, and a fourth sidewall 15*b*. The first sidewall 12*b*, the second sidewall 13*b*, the third sidewall 14*b*, and the fourth sidewall 15*b* all extend around a periphery of the base 11*b*. The first sidewall 12*b*, the second sidewall 13*b*, the third sidewall 14*b*, and the fourth sidewall 15*b* respectively connect to each other. The first sidewall 12*b*, the second sidewall 13*b*, the third sidewall 14*b*, the fourth sidewall 15*b*, and the base 11*b* cooperatively define a cavity with an opening. An end of each of the first sidewall 12*b*, the second sidewall 13*b*, the third sidewall 14*b*, and the fourth sidewall 15*b* bends outward and respectively forms a first excess 121*b*, a second excess 131*b*, a third excess 141*b*, and a fourth excess 151*b*. The first excess 121*b*, the second excess 131*b*, the third excess 141*b*, and the fourth excess 151*b* respectively connect to each other. Each of the first excess 121*b*, the second excess 131*b*, the third excess 141*b*, the fourth excess 151*b*, and the base 11*b* form a corresponding connecting portion 122*b*, 132*b*, 142*b*, and 152*b*. In other words, the preform 10*b* includes an article portion and an excess portion. The article portion of the preform 10*b* consists of the base 11*b* and the sidewalls 12*b*, 13*b*, 14*b*, 15*b*. The excess portion of the preform 10*b* consists of the excesses 121*b*, 131*b*, 141*b*, 151*b*.

Also referring to FIG. 8, an apparatus 100 includes an upper mold 110, a lower mold 130, and a positioning member 150. The upper mold 110 is opposite to the lower mold 130, and the upper mold 110 is movable relative to the lower mold 130. The upper mold 110 defines a rectangular depression (not labeled) opposite to the lower mold 130. The rectangular depression forms a first side surface 112, a second side surface 113, a third side surface 114, and a fourth side surface 115. The first side surface 112, the second side surface 113, the third side surface 114, and the fourth side surface 115 respectively connect to each other. The side surface 112, 113, 114, and 115 respectively forms a first sharp edge 1121, a second sharp edge 1131, a third sharp edge 1141, and a fourth sharp edge 1151. The first sharp edge 1121, the second sharp edge 1131, the third sharp edge 1141, and the fourth sharp edge 1151 respectively connect to each other. The lower mold 130 includes cutting side 131. The cutting side 131 includes a first cutting edge 132, a second cutting edge 133, a third cutting edge 134, and a fourth cutting edge 135. The first cutting edge 132, the second cutting edge 133, the third cutting edge 134, and the fourth cutting edge 135 correspond to the first sharp edge 1121, the second sharp edge 1131, the third sharp edge 1141, and the fourth sharp edge 1151, respectively. A horizontal width of the first cutting edge 132 is substantially equal to that of the first sharp edge 1121. A horizontal width of the second cutting edge 133 is substantially equal to that of the second sharp edge 1131. A horizontal width of the third cutting edge 134 is substantially equal to that of the third sharp edge 1141. A horizontal width of the fourth cutting edge 135 is substantially equal to that of the fourth sharp edge 1151.

In a process of making the metallic casing 10*a* shown in FIG. 6, the preform 10*b* is placed into the rectangular depression of the upper mold 110. The connecting portions 122*b*, 132*b*, 142*b*, 152*b* are located at the cutting edges 1121, 1131, 1141, 1151 respectively. The positioning member 150 is placed into the cavity of the preform 10*b* so that the preform 10*b* is fixed in the rectangular depression of the upper mold 110.

The upper mold 110 moves vertically to the lower mold 130 to keep the first sharp edge 1121, the second sharp edge 1131, the third sharp edge 1141, and the fourth sharp edge 1151 substantially coplanar with the first cutting edge 132, the second cutting edge 133, the third cutting edge 134, and the fourth cutting edge 135, respectively. The lower mold 130 moves horizontally in a first direction at a predetermined distance such that the first cutting edge 132 moves beyond the first sharp edge 1121. Thus, the first excess 121*b* is sliced from the first sidewall 12*b*. Similarly, the lower mold 130 moves horizontally in a second, third, and fourth direction at a predetermined distance in that order, such that the second cutting edge 133, the third cutting edge 134, and the fourth cutting edge 135 moves beyond the second sharp edge 1131, the third sharp edge 1141, and the fourth sharp edge 1151. Thus the second excess 131*b*, the third excess 141*b*, and the fourth excess 15 lb are sliced from the second sidewall 13*b*, the third sidewall 14*b*, and the fourth sidewall 15*b*, respectively. The rotary cutting process is completed, thereby yielding an article 10*c* (shown in FIG. 9). After that, the first sidewall 12*b* defines a slot 123 for receiving electronic components such as a connector. Thus, a metallic casing 10*a* is formed.

In a process of making the metallic casing 10*a*, the first excess 121*b*, the second excess 131*b*, the third excess 141*b*, and the fourth excess 151*b* respectively connect to each other. After the first excess 121*b*, the second excess 131*b*, and the third excess 141*b* are sliced from the preform 10*b*, the excess portion of the preform 10*b* is not separated from the preform 10*b* completely because the fourth excess 151*b* of the excess portion is still connected with the fourth sidewall 15. When the fourth excess 151*b* is sliced from the preform 10*b*, the excess portion of the preform 10*b* is separated from the preform 10*b* completely. The location where the excess portion is completely separated from the preform 10*b* is at a boundary between the first sidewall 12*b* and the fourth sidewall 15*b*.

The excess portion of the preform 10*b* moves together with the lower mold 130 at the moment that the fourth excess 151*b* separates from the preform 10*b*, thereby generating a tearing effect to the boundary between the first sidewall 12*b* and the fourth sidewall 15*b*. Hence, after the rotary cutting process is completed, a gap 16*b* is formed at the top edge of the boundary between the first sidewall 12*b* and the fourth sidewall 15*b*. The gap 16*b* makes a case made from the preform 10*b* having poor appearance. Thus an extra process, such as polishing, is required to remove the gap 16*b*.

Therefore, a new method and apparatus is desired in order to overcome the above-described shortcomings.

SUMMARY

An apparatus for use in making a metallic casing includes a first mold and a second mold. The first mold is opposite and movable relative to the second mold. The first mold defines a rectangular depression opposite to the second mold. The rectangular depression forms a plurality of side surfaces connected to each other respectively. Each side surface has a sharp edge. The second mold includes a plurality of cutting edges corresponding to the sharp edges respectively and one of the cutting edges has a secondary-cutting edge.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present method and apparatus for making a metallic casing. Moreover, in the drawings, like reference numerals designate corresponding parts throughout the several views.

DETAILED DESCRIPTION OF THE EMBODIMENTS

The present apparatus is used for making metallic casings. Any kind of metal or alloy can be used as a material of the casing. In one embodiment, aluminum alloy is the material used in the apparatus for making the metallic casing.

Figure 1:
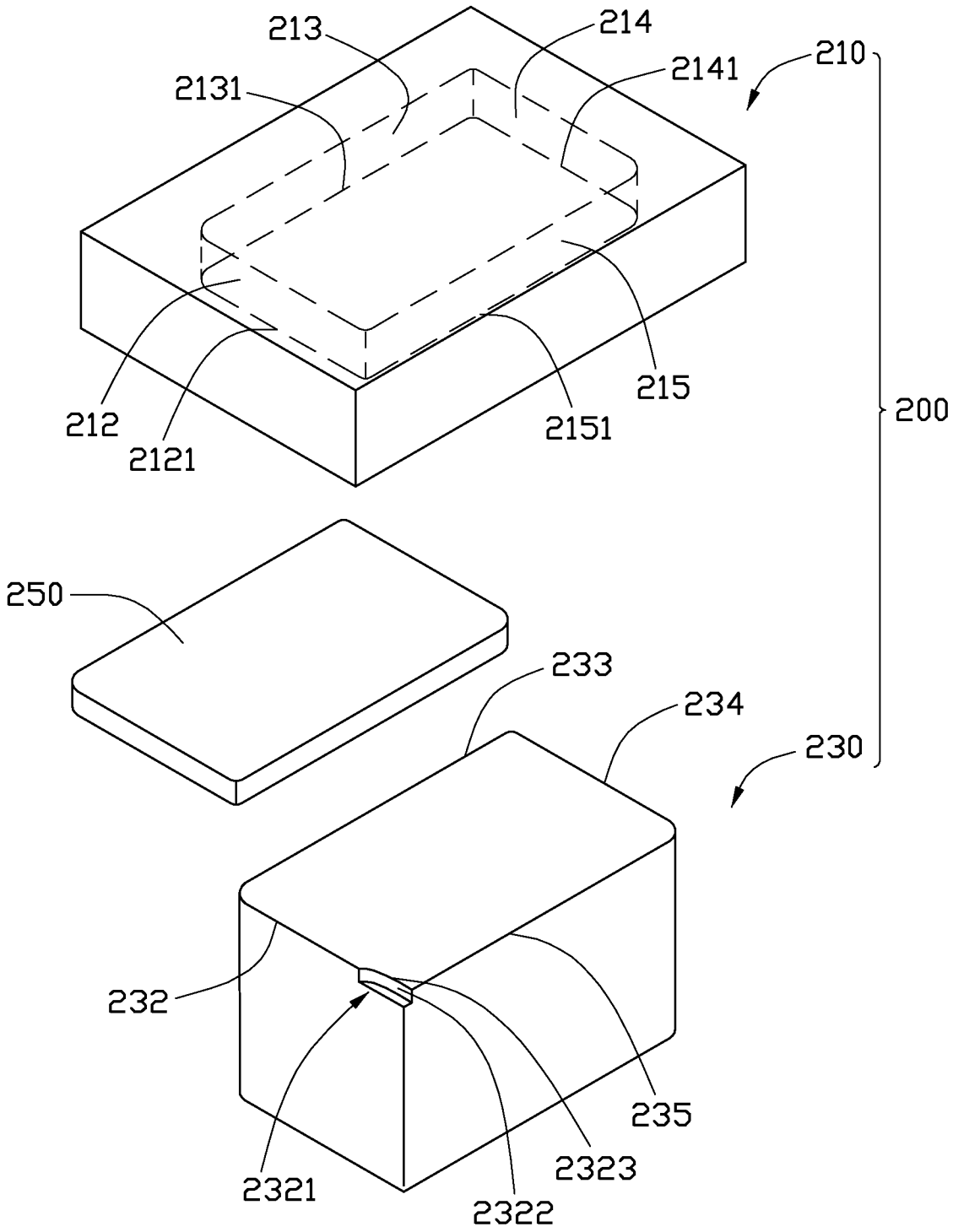
FIG. 1 is an exploded, isometric view of an apparatus in accordance with one embodiment of the present disclosure.

Referring the FIG. 1, an apparatus 200 for making a metallic casing includes an upper mold 210, a lower mold 230, and a positioning member 250. The positioning member 250 is a substantially flat plate. The upper mold 210 and the lower mold 230 are on opposite sides of the positioning member. The upper mold 210 is movable relative to the lower mold 230. The upper mold 210 defines a rectangular depression opposite to the lower mold 230. The rectangular depression forms a first side surface 212, a second side surface 213, a third side surface 214, and a fourth side surface 215. The first side surface 212, the second side surface 213, the third side surface 214, and the fourth side surface 215, respectively connect to each other. The first side surface 212, the second side surface 213, the third side surface 214, and the fourth side surface 215 respectively forms a first sharp edge 2121, a second sharp edge 2131, a third sharp edge 2141, and a fourth sharp edge 2151. The lower mold 230 has a cutting side 231. The cutting side 231 includes a first cutting edge 232, a second cutting edge 233, a third cutting edge 234, and a fourth cutting edge 235. The first cutting edge 232 is adjoining to the fourth cutting edge 235, and the first cutting edge 232 defines a cutout 2321 adjacent to the fourth cutting edge 235. The cutout 2321 is a groove defined in the first cutting edge 232, and the groove forms a sidewall 2322. An edge of the sidewall 2322 forms an arcuate secondary-cutting edge 2323.

Figure 2:
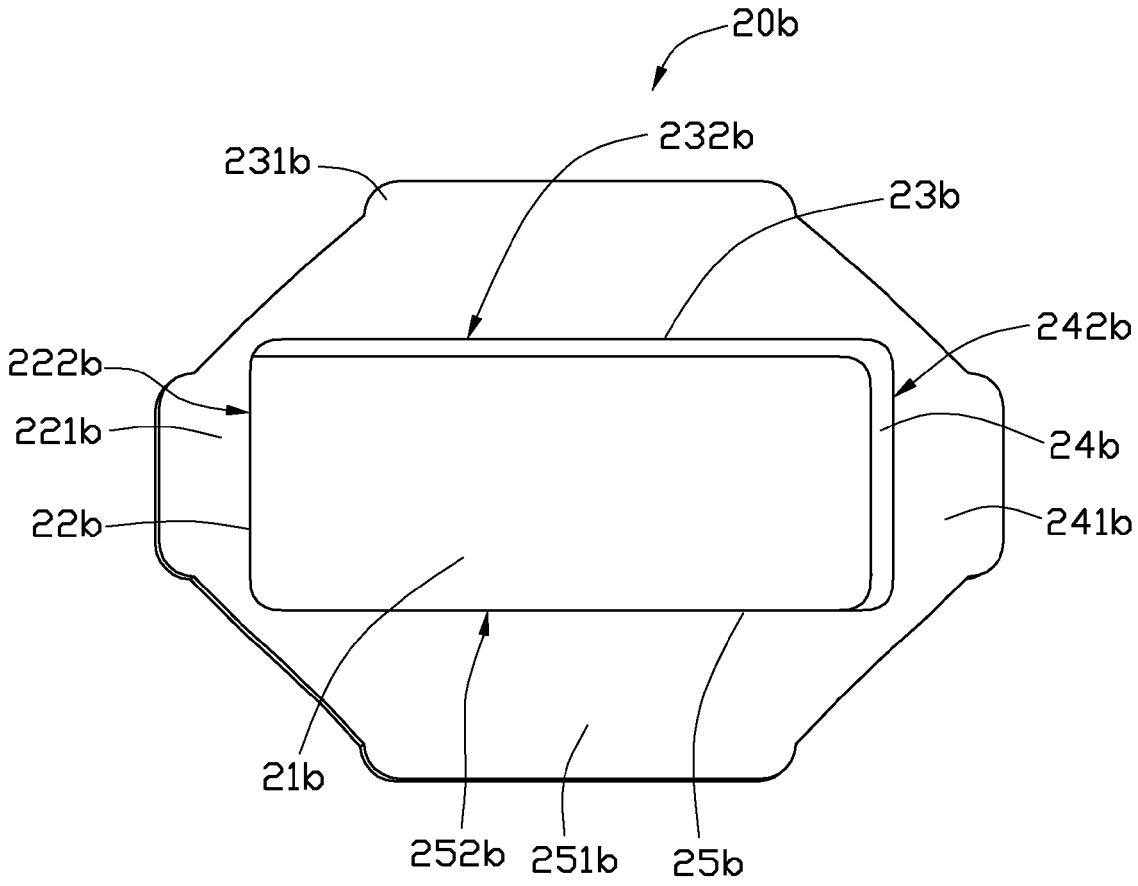
FIG. 2 is an isometric view of a preform needed to be processed by the apparatus shown in FIG. 1.
Figure 3:
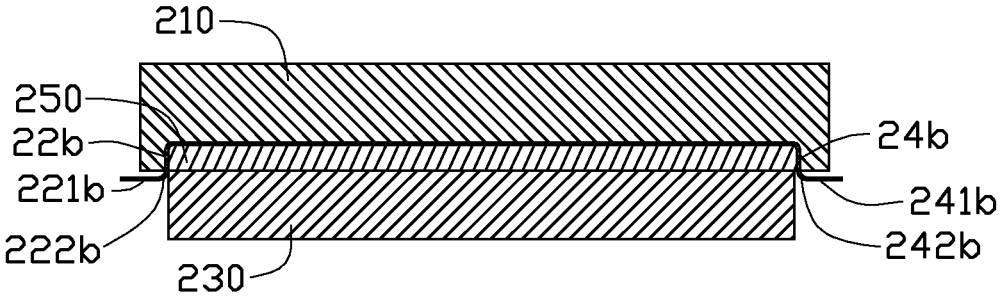
FIG. 3 is a cross-sectional view of the apparatus shown in FIG. 1 when processing the preform of FIG. 2.
Figure 4:
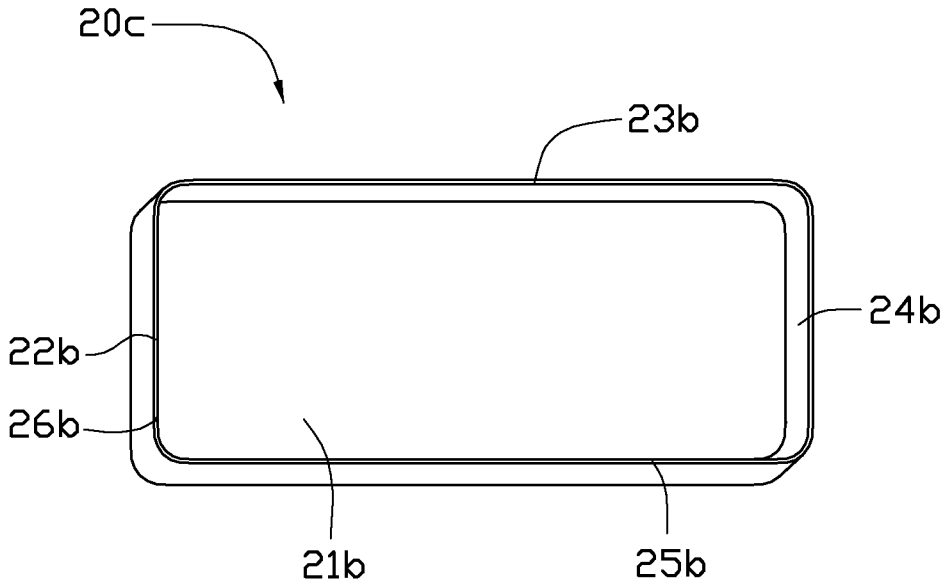
FIG. 4 is an isometric view of an article made from the preform of FIG. 2.

Referring to FIGS. 2 and 3, the apparatus 200 is used for processing a preform 20*b* (shown in FIG. 2) by a rotary cutting process, thereby yielding an article 20*c* (shown in FIG. 4). The preform 20*b* is manufactured by a drawing process. The preform 20*b* includes an approximately rectangular base 21*b*, a first sidewall 22*b*, a second sidewall 23*b*, a third sidewall 24*b*, and a fourth sidewall 25*b*. The first sidewall 22*b*, the second sidewall 23*b*, the third sidewall 24*b*, and the fourth sidewall 25*b* all extend around a periphery of the base 21*b*. The first sidewall 22*b*, the second sidewall 23*b*, the third sidewall 24*b*, and the fourth sidewall 25*b*, respectively connect to each other. Each end of the first sidewall 22*b*, the second sidewall 23*b*, the third sidewall 24*b*, and the fourth sidewall 25*b* bends outwardly and respectively forms a first excess 221*b*, a second excess 231*b*, a third excess 241*b*, and a fourth excess 25 lb. The first excess 221*b*, the second excess 231*b*, the third excess 241*b*, and the fourth excess 251*b*, respectively connect to each other. The excesses 221*b*, 231*b*, 241*b*, 251*b*, and the sidewalls 22*b*, 23*b*, 24*b*, 25*b* form connecting portions 222*b*, 232*b*, 242*b*, 252*b*, respectively. In other words, the preform 20*b* includes an article portion and an excess portion. The article portion consists of the base 21*b*, the first sidewall 22*b*, the second sidewall 23*b*, the third sidewall 24*b*, and the fourth sidewall 25*b*. The excess portion consists of the first excess 221*b*, the second excess 231*b*, the third excess 241*b*, and the fourth excess 251*b*.

In the making process, the preform 20*b* is placed into the rectangular depression of the upper mold 210. The connecting portion 222*b* between the first sidewall 22*b* and the first excess 221*b* is located adjacent to the first sharp edge 2121. The connecting portion 232*b* between the second sidewall 23*b* and the second excess 231*b* is located at the second sharp edge 2131. The connecting portion 242*b* between the third sidewall 24*b* and the third excess 241*b* is located at the third sharp edge 2141. The connecting portion 252*b* between the fourth sidewall 25*b* and the fourth excess 251*b* is located at the fourth sharp edge 2151. The positioning member 250 is placed into the cavity of the preform 20*b* so that the preform 20*b* is fixed in the rectangular depression of the upper mold 210.

The upper mold 210 moves vertically against (toward) the lower mold 230 until the first sharp edge 2121, the second sharp edge 2131, the third sharp edge 2141, and the fourth sharp edge 2151 are substantially coplanar with the first cutting edge 232, the second cutting edge 233, the third cutting edge 234, and the fourth cutting edge 235, respectively.

The lower mold 230 then moves horizontally in a first direction at a predetermined distance such that the first cutting edge 232 moves beyond the first sharp edge 2121. As a result, the first excess 221*b* is sliced from the first sidewall 22*b*. The first cutting edge 232 defines a cutout 2321 adjacent to the fourth cutting edge 235, by controlling the predetermined distance, a portion of a connecting portion formed between the first excess 221*b* and the first sidewall 22*b* can be kept un-sliced (uncut/separated). In the preferred embodiment, the predetermined distance is a distance such that the cutout 2321 does not go beyond the first sharp edge 2121, thus leaving an uncut portion.

The lower mold 230 then moves horizontally in a second, third, and fourth direction at a predetermined distance in that order, such that the second cutting edge 233, the third cutting edge 234, and the fourth cutting edge 235 moves beyond the second sharp edge 2131, the third sharp edge 2141, and the fourth sharp edge 2151. Thus the second excess 231*b*, the third excess 241*b*, and the fourth excess 251*b* are sliced from the second sidewall 23*b*, the third sidewall 24*b*, and the fourth sidewall 25*b*, respectively. A partial cut procedure is completed.

After the partial cut procedure, an uncut portion remains. The lower mold 230 then moves horizontally in the first direction at a greater distance than the first time such that the secondary-cutting edge 2323 moves beyond the first sharp edge 2121. Thus the uncut portion is cut or sliced. A final cut procedure is completed.

After the final cut procedure, the first excess 221*b*, the second excess 231*b*, the third excess 241*b*, and the fourth excess 251*b* are completely removed from the preform 20*b*. That is, the excess portion is separated from the preform 20*b*, and then the article portion of the preform 20*b* is extracted, yielding an article 20*c* (shown in FIG. 4).

Figure 5:
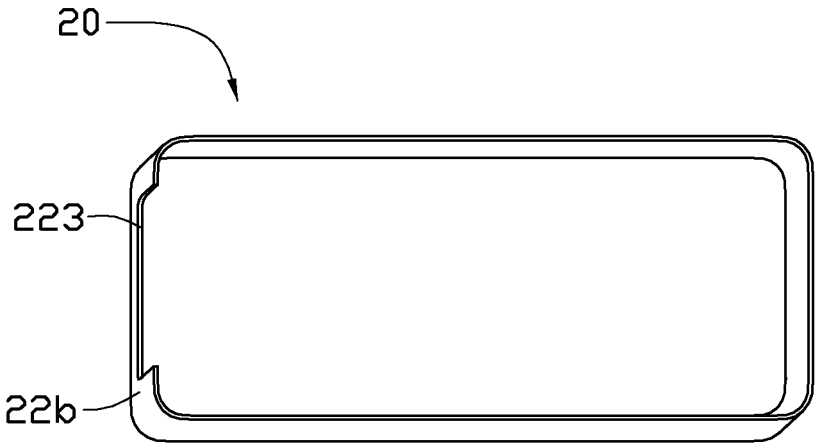
FIG. 5 is an isometric view of a metallic casing made from the preform of FIG. 4.
Figure 6:
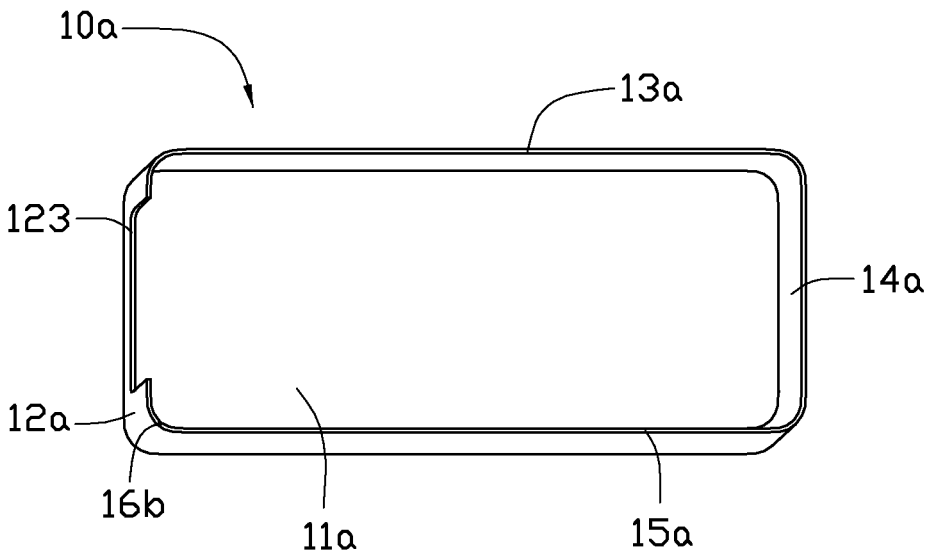
FIG. 6 (RELATED ART)
FIG. 6 is an exploded, isometric view of a related metallic casing.
Figure 7:
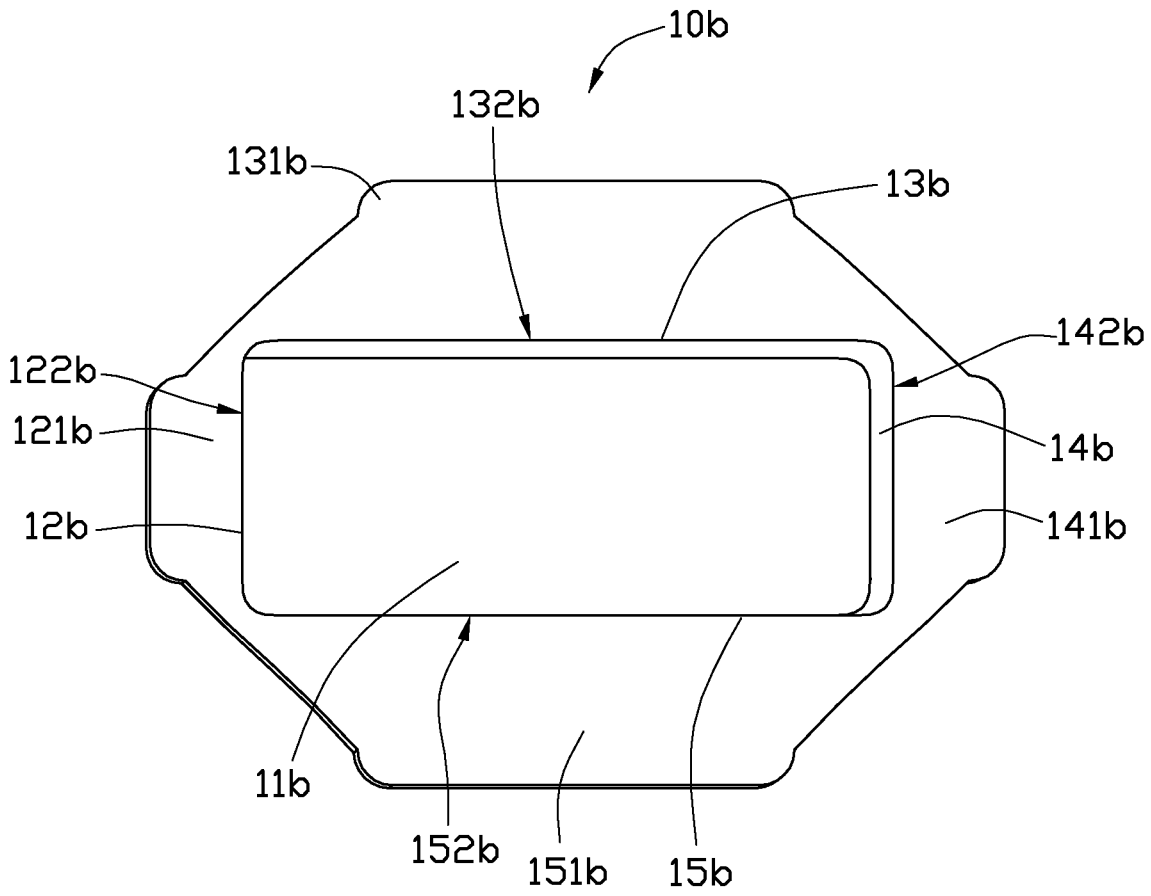
FIG. 7 (RELATED ART)
FIG. 7 is an exploded, isometric view of a related preform.
Figure 8:
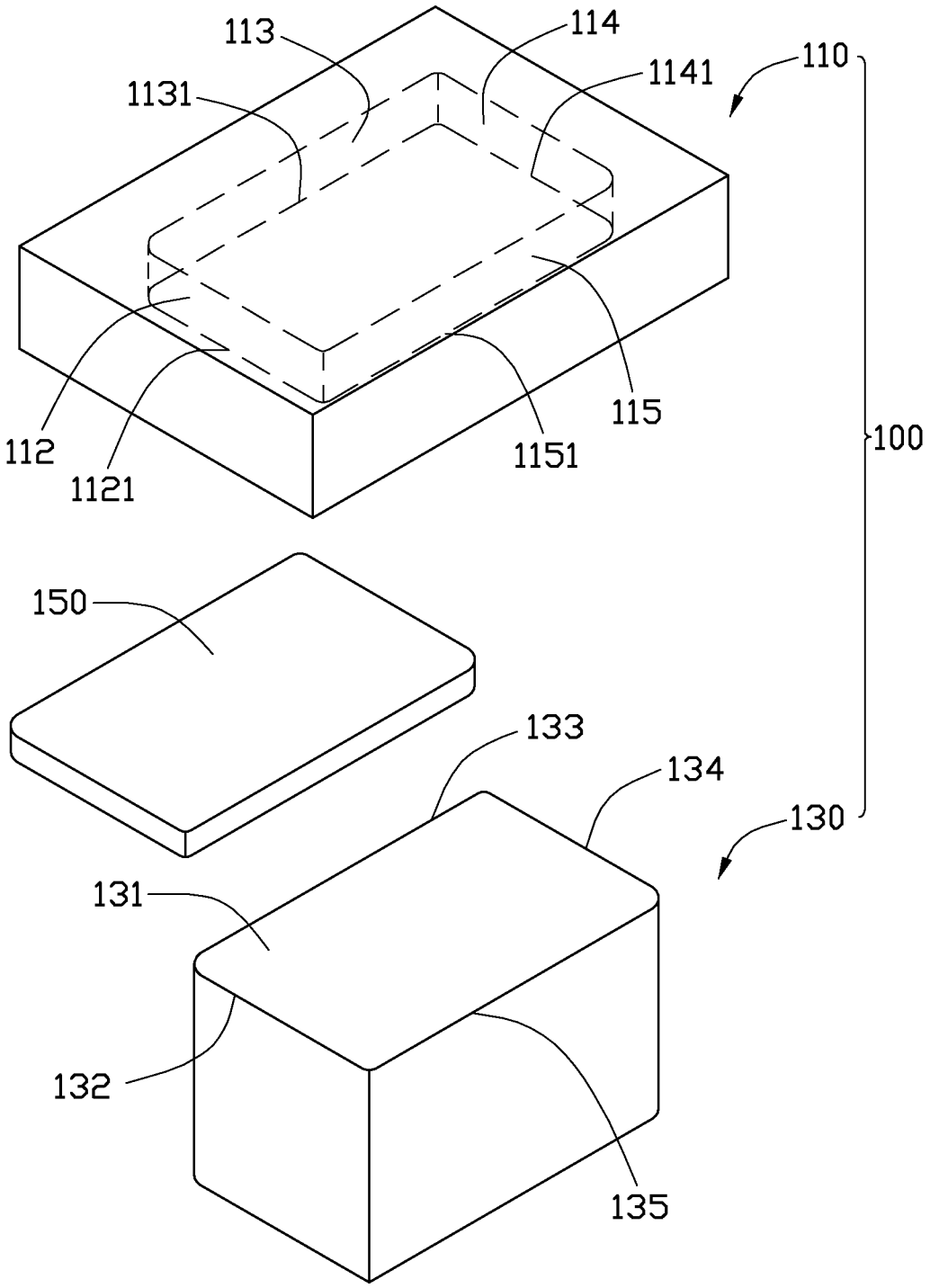
FIG. 8 (RELATED ART)
FIG. 8 is an isometric view of a related apparatus used for processing the preform of FIG. 7.
Figure 9:
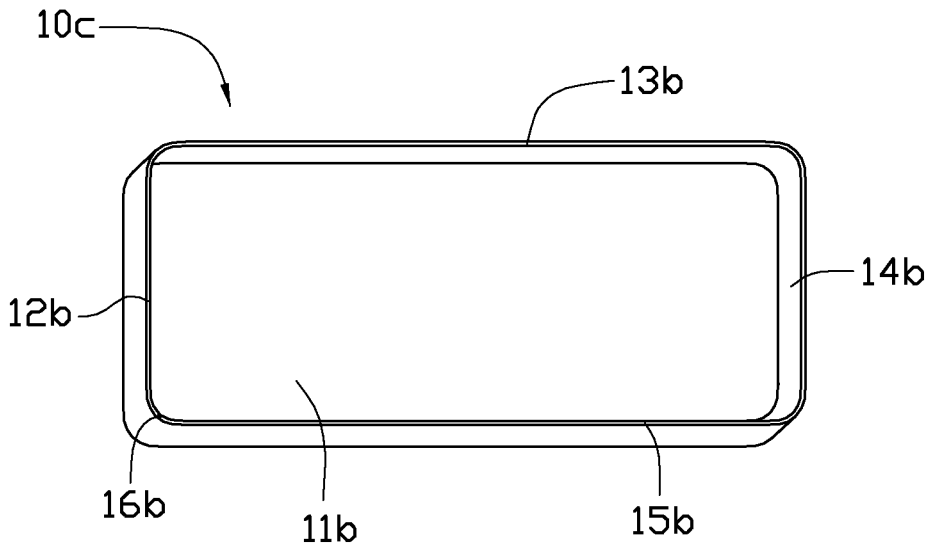
FIG. 9 (RELATED ART)
FIG. 9 is an isometric view of a related article made from the preform of FIG. 8.

The position member 250 is separated from the top mold and the article 20*c* is removed out of the rectangular depression. Finally, a slot 223, configured for receiving electronic components such as a connector, is defined in the first sidewall 22*b* of the article 20*c*. Thus, a metallic casing 20 (shown in FIG. 5) is formed.

In the above mentioned process, when the uncut portion is cut or sliced, a gap 26*b* is defined in the top edge of the first sidewall 22*b* because the uncut portion is a part of the first sidewall. In addition, the first sidewall 22 is generally required to define a slot 223 for receiving electronic components such as a connector, and the slot 223 can be defined at an area where the gap 26*b* is located. The gap 26*b* can then be eliminated when defining the slot 223. In the preferred embodiment, the slot 223 can be defined by a side punching process with a mold. The appealing appearance is achieved without extra process.

The preform 20*b* may includes three sidewalls, five or more sidewalls. When the number of the cutting edges is equal to that of the edges and the sidewalls of the preform 20*b*, the number of the cutting edges of the upper mold and the edges of the lower mold may increase or decrease correspondingly. In an alternative embodiment, the cutout may be defined in another location such as a middle portion of the first cutting edge or a portion of the second cutting edge. In another embodiment, the cutout may be an inclined plane, the shape of the secondary-cutting edge may be an ellipse, linear, or any other shape.

Depending on the embodiment, certain of the steps described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is believed that the present embodiments and their advantages will be understood from the foregoing description, and it will be apparent that various changes may be made thereto without departing from the spirit and scope of the application or sacrificing all of its material advantages, the examples hereinbefore described merely being embodiments of the application.

What is claimed is:

1. A method for making a metallic casing, the method comprising:

providing an apparatus comprising a first mold and a second mold, the first mold being opposite and movable relative to the second mold, the first mold defining a rectangular depression opposite to the second mold, the rectangular depression comprising a plurality of side surfaces connected to each other, each side surface having a sharp edge, the second mold comprising a plurality of cutting edges corresponding to the sharp edges, and one of the cutting edges having a secondary-cutting edge;

placing a preform into the rectangular depression of the first mold, the preform comprising a base and a plurality of sidewalls extending from a periphery of the base, the plurality of sidewalls connected to each other, an end of each sidewall bending outward and forming an excess, the plurality of the excesses connected to each other, each connecting portion between a corresponding sidewall and a corresponding excess being located at a corresponding sharp edge;

moving the first mold to the second mold so that each sharp edge is substantially coplanar with a corresponding cutting edge;

moving the first mold to the second mold so that the cutting edges are beyond the corresponding sharp edges of the first mold to complete a partial cut procedure in a predetermined sequence, wherein in the partial cut procedure, the first cutting edge having the secondary-cutting edge partially cuts the corresponding connecting portion between the sidewall and the corresponding excess;

moving the first mold to the second mold so that the secondary-cutting edge moves beyond the corresponding sharp edge, and completely cuts the excess off the side wall.

2. The method as claimed in claim 1, wherein the side surfaces comprises a first side surface, a second side surface, and a third side surface, the cutting edges comprises a first cutting edge, a second cutting edge, and a third cutting edge; the first cutting edge adjoins the second and the third cutting edge, the first cutting edge defines a cutout adjacent to the third cutting edge, the secondary-cutting edge is formed at the cutout; in the partial cut procedure, the first cutting edge partially cuts the corresponding connecting portion between the corresponding sidewall and the corresponding excess and then the third cutting edge cuts the connecting portion between the corresponding sidewall and the corresponding excess.

3. The method as claimed in claim 2, wherein the method further comprises a side punching process for side punching the sidewall cut by the first cutting edge.

4. The method as claimed in claim 1, wherein the secondary-cutting edge is arcuate.

5. The method as claimed in claim 1, wherein the apparatus further comprises a locating member for fixing the preform in the rectangular depression.

6. The method as claimed in claim 1, wherein the first mold comprises four sharp edges, and the second mold includes four cutting edges corresponding to the four sharp edges respectively.

7. The method as claimed in claim 1, wherein a material of the preform is aluminum or aluminum alloy.

8. A method for making a metallic casing, the method comprising:

providing an apparatus comprising a first mold and a second mold, the first mold being opposite and movable relative to the second mold, the first mold defining a rectangular depression opposite to the second mold, the rectangular depression forming a plurality of side surfaces connected to each other, each side surface having a sharp edge, the second mold comprising a plurality of cutting edges corresponding to the sharp edges respectively, the plurality of cutting edges comprising a first cutting edge, a second cutting edge, and a third cutting edge, the first cutting edge adjoining the second and the third cutting edges, the first cutting edge defining a cutout formed on an end thereof and directly connected to the third cutting edge, a secondary-cutting edge formed at the cutout, and the second mold capable of being horizontally moved to move the first, second, and third cutting edges beyond the corresponding sharp edges in a predetermined sequence;

placing a preform into the rectangular depression of first mold, the preform comprising a base and a plurality of sidewalls extending from a periphery of the base, the plurality of sidewalls connected to each other, an end of each sidewall bending outward and forming a excess, the plurality of the excesses connected to each other, each connecting portion between a corresponding sidewall and a corresponding excess being located at a corresponding sharp edge;

moving the first mold to the second mold so that each sharp edge is substantially coplanar with a corresponding cutting edge;

moving the first mold to the second mold so that the cutting edges are beyond the corresponding sharp edges of the first mold in order to complete a partial cut procedure, wherein in the partial cut procedure, the first cutting edge cuts the corresponding connecting portion between the corresponding sidewall and the corresponding excess partially; and moving the first mold to the second mold so that the secondary-cutting edge moves beyond the corresponding sharp edge and completely cuts the excess off the side wall.

* * * * *